US006461448B1

(12) United States Patent
Williams et al.

(10) Patent No.: US 6,461,448 B1
(45) Date of Patent: Oct. 8, 2002

(54) LOW TEMPERATURE CASE HARDENING PROCESSES

(75) Inventors: Peter C. Williams, Cleveland Heights; Steven V. Marx, University Heights, both of OH (US)

(73) Assignee: Swagelok Company, Solon, OH (US)

( * ) Notice: Subject to any disclaimer, the term of this patent is extended or adjusted under 35 U.S.C. 154(b) by 0 days.

(21) Appl. No.: 09/570,671

(22) Filed: May 15, 2000

Related U.S. Application Data

(62) Division of application No. 09/133,040, filed on Aug. 12, 1998, now Pat. No. 6,093,303.

(51) Int. Cl.[7] ..... C23C 8/44; C23C 8/46

(52) U.S. Cl. ..... 148/225; 148/237

(58) Field of Search ..... 148/206, 217, 148/225, 237

(56) References Cited

U.S. PATENT DOCUMENTS

| | | | | |
|---|---|---|---|---|
| 1,279,457 | A | 9/1918 | Shimer | |
| 1,789,259 | A | 1/1931 | Shimer et al. | |
| 1,923,814 | A | 8/1933 | Egan | 148/16 |
| 2,057,813 | A | 10/1936 | Babinet | 148/4 |
| 2,204,148 | A | 6/1940 | Nelms | 266/2 |
| 2,789,930 | A | 4/1957 | Englehard | 148/16.6 |
| 2,851,387 | A | 9/1958 | Low | 148/16.6 |
| 3,321,338 | A | 5/1967 | Caubet | |
| 3,535,169 | A | 10/1970 | Caubet | |
| 3,876,512 | A | 4/1975 | Hiyama | |
| 4,268,323 | A | 5/1981 | Jakubowski et al. | |
| 4,746,375 | A | 5/1988 | Iaconvangelo | 148/20.3 |

(List continued on next page.)

FOREIGN PATENT DOCUMENTS

| | | | |
|---|---|---|---|
| DE | 54962 | A * | 12/1981 |
| EP | 0054962 | B1 | 4/1985 |
| EP | 0147011 | A2 | 7/1985 |
| EP | 0421236 | B1 | 5/1993 |
| EP | 0408168 | B1 | 6/1994 |
| EP | 0303191 | B1 | 12/1994 |
| EP | 0678589 | A1 | 10/1995 |
| EP | 0532386 | B1 | 4/1996 |
| EP | 0551702 | B1 | 6/1998 |
| FR | 2722212 | A1 | 7/1995 |
| SU | 1666573 | A1 | 7/1991 |
| SU | 1678896 | A1 | 9/1991 |
| SU | 1752828 | A1 | 8/1992 |

OTHER PUBLICATIONS

Donald R. Olander, "Fundamental Aspects of Nuclear Reactor Fuel Elements," *Technical Information Center, Office of Public Affairs, Energy Research and Development Administration*, 1976, pp. 517–519, 548–555.

J.K.L. Lai, "Review of Precipitation Behaviour in AISI Type 316 S," *Materials Science and Engineering*, 61, 1983, pp. 101–109.

(List continued on next page.)

*Primary Examiner*—Roy King
*Assistant Examiner*—Harry D. Wilkins, III
(74) *Attorney, Agent, or Firm*—Calfee, Halter & Griswold, LLP

(57) ABSTRACT

A method for case hardening a chromium bearing nickel or ferrous based alloy, for example stainless steel, article, the method including the steps of activating the surface of the article; and carburizing the activated surface at a temperature below that temperature which would promote the formation of carbides. In one embodiment the surface is activated by disposing a layer of iron over the surface of the article.

23 Claims, 1 Drawing Sheet

U.S. PATENT DOCUMENTS

| | | | | |
|---|---|---|---|---|
| 4,975,147 | A | 12/1990 | Tahara et al. | 156/646 |
| 5,013,371 | A | 5/1991 | Tahara et al. | 148/16.6 |
| 5,102,476 | A | 4/1992 | Wahl | |
| 5,141,567 | A | 8/1992 | Tahara et al. | 148/271 |
| 5,160,553 | A | 11/1992 | Leban et al. | |
| 5,194,097 | A | 3/1993 | Tahara et al. | 148/234 |
| 5,252,145 | A | 10/1993 | Tahara et al. | 148/206 |
| 5,254,181 | A | 10/1993 | Yoshino et al. | 148/231 |
| 5,340,412 | A | 8/1994 | Yoshino et al. | 148/208 |
| 5,376,188 | A | 12/1994 | Tahara et al. | 148/230 |
| 5,424,028 | A | 6/1995 | Maloney et al. | 148/319 |
| 5,447,181 | A | 9/1995 | Tahara et al. | 148/206 |
| 5,556,483 | A | 9/1996 | Tahara et al. | |
| 5,593,510 | A | 1/1997 | Tahara et al. | |
| 5,650,022 | A | 7/1997 | Kitano et al. | 148/228 |
| 5,653,822 | A | 8/1997 | Stickels et al. | 148/220 |
| 5,735,971 | A | 4/1998 | Wahl et al. | |
| 5,753,052 | A | 5/1998 | Dajoux et al. | |
| 5,792,282 | A | 8/1998 | Tahara et al. | 148/206 |
| 6,126,102 | A | 10/2000 | Mycielski et al. | |

OTHER PUBLICATIONS

B.H. Kolster Et Al., "An Expression for Monometallic Corrosion Rate in Liquid Sodium," *Corrosion and Mass Transfer*, AIME, 1973, pp. 252–264.

B.H. Kolster, "Mechanism of Fe and Cr Transport by Liquid Sodium in Non–Isothermal Loop Systems," *Journal of Nuclear Materials* 55 (1975), pp. 155–168.

B.H. Kolster Et Al., "Corrosion, Transport and Deposition of Stainless Steel in Liquid Sodium," *Int'l. Conference on Liquid Metal Technology in Energy Production*, 1976, pp. 368–377.

B.H. Kolster, "The Influence of Sodium Conditions on the Rate for Dissolution and Metal/Oxygen Reaction of AISI 316 in Liquid Sodium," *Second Int'l. Conference on Liquid Metal Technology in Energy Production*, Apr. 1980, pp. 7–53–7–61, Richland, WA.

B.H. Kolster, "Discussion of Sodium Corrosion and Mass Transfer," *Material Behavior and Physical Chemistry in Liquid Metal Systems*, Mar. 1981, pp. 489–491, Karlsrule, Germany.

B.H. Kolster Et Al., "The Deposition Behavior of Fe, Cr, Ni, Co and Mn in Stainless Steel Sodium Loops," *Conference: Material Behavior and Physical Chemistry in Liquid Metal Systems*, Mar. 1981, pp. 37–48, Karlsrule, Germany.

P.L.F. Rademakers Et Al., "Influence of Heat Treatment on Decarburization of 2¼CrlMo Steel in Liquid Sodium," *Proc. Conf. on Ferritic Steels for Fast Reactor Steam Generators*, vol. 2, 1978, pp. 289–292, BNES, London.

P.L.F. Rademakers Et Al., "Corrosion of Various Ferritic Steels in an Isothermal Sodium Loop System," *Journal of Nuclear Materials* 97, 1981, pp. 309–318, North–Holland Publ. Co.

B.H. Kolster, "Wear and Corrosion Resistant Coatings on Austenitic Steels," *VDI–Berichte (Assn. of German Eng.)*, Rep. 506, 1983, pp. 1–17, translation.

U. Gramberg Et Al., "Improvement of the Vibratory Fatigue Limit and of the Corrosion and Wear Resistance through Selectively Targeted Surface Treatments," *VDI–Berichte (Assn. of German Eng.)* Rep. 506, 1983, pp. 1–13, translation.

B.H. Kolster Et Al., "Sodium Corrosion in a Total Molybdenum Loop System: Construction, Experience and Results," *Liquid Metal Eng. and Tech.*, 1984, pp. 235–241, BNES, London.

B.H. Kolster, "Development of a Stainless and Wear–Resistant Steel," (Rep.) *Materialen*, No. 8, Oct. 1987, pp. 1–12.

R.H. Van Der Jagt, Et Al, "Anti–Wear/Corrosion Treatment of Finished Austentitic Stainless Steel Components: The Hardcor Process," *Materials & Design*, vol. 12, No. 1, Feb. 1991, pp. 41–46.

R. Kossowsky Et Al., "Surface Modification of 300 Series Stainless Steels by the Kolsterizing Process," *The 17th Ann. Meeting of the Society for Biomaterials*, May 1–5, 1991, p. 225, Scottsdale, AZ.

M. Gillham Et Al., "New Case Hardening Process for Austenitic Stainless Steels," *Materials World*, Aug. 1996, pp. 460–462.

"Kolsterizing . . . a case–hardening process for austenitic stainless steel (for example 316)," cover page, *HARDifference*, Hardiff BV.

"Case Hardening Stainless Steel Without Disadvantages," *Metallurgia*, Apr. 1998.

"Parker Suparcase Gives You Superior Technology," advertisement, Parker–Hannifin.

"A Survey of Instrumentation Tubing Connectors with Metallurgical and Interchange Consideration," Parker Hannifin and Cumberland Valve and Fitting Company, Jul. 11, 1991 (conf.).

Meeting memo between representatives of Hardiff bv and Swagelok, partially redacted, Apr. 20–22, 1997, p. 2.

Japanese Abstract of Publication No. 04128361A, published Apr. 28, 1992.

Japanese Abstract of Publication No. 06010242A, published Jan. 18, 1994.

Japanese Abstract of Publication No. 60067651A, published Apr. 18, 1985.

English translation of Japanese Laid–Open (Kokai) Publication No. 10–18017.

English translation of Japanese Laid–Open (Kokai) Publication No. 6–228732.

"The corrosion behavior of chromium in hydrogen chloride gas and gas mixtures of hydrogen chloride and oxygen at high temperature," *Corrosion Science*, vol. 23(2), 1983, pp. 167–181.

Lewis Et Al., "Metallurgical Study of Low–Temperature Plasma Carbon Diffusion Treatments for Stainless Steels," *Surface and Coating Technology*, vol. 60, 1993.

Stevenson Et Al., "The Effect of Process Parameters on the Plasma Carbon Diffusion Treatment of Stainless Steels at Low Pressure," vol. 63, 1994.

Excerpts from the file of European Patent Application No. 95302521.0 of Daido Hoxan, describing the "Hardcore Process."

Search Report of Shusaku Yamamoto, dated Dec. 18, 2000, including English Abstracts of Japanese Publication Nos. 54–13427 (1), 52–96937 (2), 54–84836 (6), and 49–3842 (7).

English Abstract of Japanese Patent No. JP56119767 of A. Toshihiko, Publ. Sep. 19, 1981.

Search Report of TNO Patent Information Office, dated Jan. 10, 2001, including English Abstracts of French Publication No. 2280715.

* cited by examiner

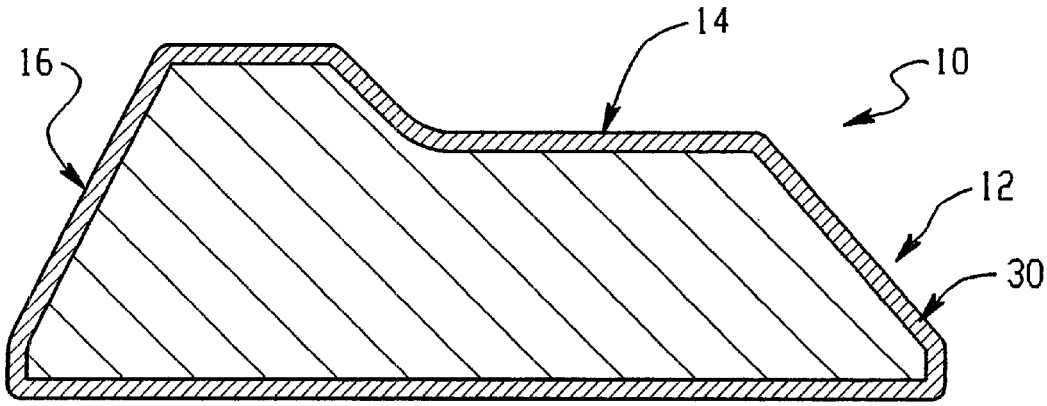
14
10
16
12
30

LOW TEMPERATURE CASE HARDENING PROCESSES

CROSS REFERENCE TO RELATED APPLICATION

The present application is a division of application Ser. No. 09/133,040, filed Aug. 12, 1998, now U.S. Pat. No. 6,093,303, the disclosure of which is incorporated herein by reference.

TECHNICAL FIELD OF THE INVENTION

The present invention relates to processing techniques for articles of stainless steel and other alloys, such as, for example, tube coupling ferrules. More particularly, the invention relates to processes for case hardening such articles substantially without the formation of carbides.

BACKGROUND OF THE INVENTION

As is well known, stainless steel is commonly used for many parts and assemblies. One example is a ferrule used as part of a fluid coupling for joining tube ends. The degree to which the stainless steel must be used will vary from application to application. In some high purity systems, for example in the semiconductor and biotechnology fields, lower carbon stainless steel such as 316L for example, is commonly used. Many chemistries for stainless steel are used, and other chromium bearing nickel or ferrous based alloys are known and used other than stainless steel.

One attribute of some stainless steel alloys is that thy are relatively less hard than other steel alloy materials. As a result in some applications, such as ferrules, the stainless steel article or part is provided with a hardened surface, referred to generally and herein as case hardening. The concept of case hardening is to transform a relatively thin layer of material at the surface of the part by enrichment of carbon or other ingredients to make the surface harder than the base metal alloy. This disclosure is directed to case hardening of an article by enrichment by carbon. The article thus retains in bulk the desired formability of stainless steel without the softness of the standard chemistry base metal at the article surface.

Stainless steel parts are case hardened by a process generally known as carburization. Carburization is a process by which carbon atoms are diffused in solution into the surface of the article. Known case hardening processes are performed at high temperatures. However, carburization processes performed at temperatures greater than about 1000° F. (for stainless steel alloys) can promote the formation of carbides in the hardened surface.

It is desired, therefore, to provide new carburization processes for case hardening chromium bearing nickel or ferrous based alloy articles and that does not promote the formation of carbides.

SUMMARY OF THE INVENTION

In accordance with one embodiment of the invention, a method for case hardening a chromium bearing nickel or ferrous based alloy article includes the steps of activating the surface of the article and carburizing the activated surface at a temperature below that temperature which would promote the formation of carbides. In one embodiment the activating step is carried out by disposing a layer of iron over the surface of the article.

These and other aspects and advantages of the present invention will be apparent to those skilled in the art from the following description of the preferred embodiments in view of the accompanying drawings.

BRIEF DESCRIPTION OF THE DRAWING

The invention may take physical form in certain parts and arrangements of parts, preferred embodiments and a method of which will be described in detail in this specification and illustrated in the accompanying drawing which forms a part hereof, and wherein:

The drawing is an elevation in longitudinal cross-section of a conventional ferrule as an example of a type of article that has been case hardened using the exemplary processes of the present invention.

DETAILED DESCRIPTION OF THE PREFERRED EMBODIMENTS

With reference to the drawing, a conventional ferrule 10 structure is illustrated wherein the ferrule has also been case hardened as set forth hereinafter. This ferrule 10 is but one example of countless many articles and parts that can be used with the present invention. While the invention is described herein with reference to a 316 type stainless steel ferrule, such description is intended to be exemplary in nature and should not be construed in a limiting sense. The present invention finds application with any part or article made of a chromium bearing nickel or ferrous based alloy base metal that is to be case hardened.

Furthermore, although the preferred embodiments are described herein with specific reference to articles made of stainless steel alloys, such descriptions are exemplary in nature and should not be construed in a limiting sense. The present invention is applicable to many types of chromium bearing ferrous or nickel based alloy chemistries, including but not limited to alloy 316, alloy 316L and alloy 304 stainless steels, alloy 600, alloy C-276 and alloy 20 Cb, to name a few examples.

The ferrule 10 is illustrated in the drawing in partial cross-section only. This particular ferrule is a rear ferrule that is used as part of a two ferrule system. Such ferrules and ferrule systems including the ferrule geometries are well known and are fully described in U.S. Pat. Nos. 4,915,427 and 3,103,373, the entire disclosures of which are fully incorporated herein by reference.

The ferrule 10 is characterized by a tapered nose portion 12, a central body 14 and a rear drive surface 16. In a tube coupling, the rear drive surface 16 engages a wall of a nut that axially drives the nose of the ferrule 10 into a rear camming mouth of a front ferrule (not shown). This action, among other things, causes the nose portion 12 of the ferrule 10 to be driven radially inward to grip a tube end. The geometry of the ferrule 10 illustrated in FIG. 1 is exemplary in nature and will vary substantially depending on the particular ferrule system. The ferrule 10 could also be used in a single ferrule system in which case the nose portion 12 is driven into a camming mouth of a forward coupling element.

A common but not exclusive material for the ferrule 10 is 316 stainless steel. To enable driving the ferrule 10 into an enhanced grip of a tube end, it is desirable in some applications to case harden the ferrule 10. As used herein, case hardening means to provide a relatively thin carburized layer at the surface of the ferrule 10 to increase the surface hardness as compared to the base metal used for the ferrule 10. Carburization is a preferred method for case hardening the ferrule 10, and in accordance with one aspect of the present invention, low temperature carburization processes are used which permit case hardening of the ferrule 10 without the formation of carbides.

Carburization in general is a process by which carbon atoms are diffused into the base alloy in solution. In order to diffuse the carbon atoms into the stainless steel, the chromium oxide layer must be removed. This step is generally known as activation or de-passivation. The surface must be activated because the oxide layer presents a substantial barrier to carbon atoms. Once activated, the surface can be carburized by diffusion at an elevated temperature.

The diffusion process can be accelerated by performing the carburization at a high temperature, for example, greater than 1000° F. However, such high temperature diffusion can readily and quickly produce carbides which are carbon/chromium molecules. Carbides tend to reduce the chromium of the base alloy in some cases.

In order to prevent or substantially eliminate the formation of carbides, the present invention contemplates carburization processes for case hardening that are performed at a temperature that is below a carbide promoting temperature. For many chromium bearing alloys such as 316 stainless steel for example, carbides tend to readily form at carburization temperatures greater than 1000° F. Therefore, case hardening processes of the present invention are performed at a temperature less than about 1000° F. for stainless steel alloys. The time period during which carburization takes place also affects carbide formation. Even at temperatures below 1000° F., carbides can form if the base metal is exposed to the carbon source for a long enough period of time. In accordance with another aspect of the invention, carburization is performed below a carbide promoting temperature and for a time period less than that which permits carbides to form. Thus, the invention contemplates a time-temperature profile that substantially prevents the formation of carbides during a case hardening process.

As an example of such a time-temperature profile, carbides readily form in 316 stainless steel above 1000° F., as fast as within an hour. However, below this temperature, for example in the 800–950° F. range, carbides will not form until about a week or more, particularly at the lower temperature range. This is but one example, and the particular time-temperature profile used in any specific carburization process for preventing carbide formation will depend on a number of factors including but not necessarily limited to the carburization temperature and the alloy chemistry of the base metal.

The general steps of the case hardening process in accordance with the present invention are 1) activating the surface area of the article that is to be carburized; 2) diffusing carbon into the activated surface area; and 3) re-passivating the article.

The passive oxide layer that forms over the stainless steel base metal of the article is a carbon blocking layer. This passive layer forms immediately with exposure of the article to air, and is formed as a chromium oxide layer. In order to carburize the article, however, the article surface needs to be activated.

In one embodiment of the invention, activation is performed by exposing the article to a hydrogen halide gas mixture of hydrogen chloride and nitrogen at atmospheric pressure. The gas mixture, for example, can be 17–100% volume hydrogen chloride or hydrogen fluoride, remainder nitrogen. The article is exposed to the activating gas for a time-temperature profile that stays below that which would promote the formation of carbides. In this example, the article is exposed to the gas mixture for about four hours at a temperature between about 600° F. and 800° F. After the article has been activated, the diffusion process can begin.

In one embodiment of the invention, the carbon atoms are diffused into the article 10 by exposing the article 10 to a carbon monoxide (CO) gas mixture. Such a gas mixture can be, for example, 0.5–60% volume carbon monoxide, 10–50% volume hydrogen, remainder nitrogen, at one atmosphere. This is performed after activation and without exposing the article to air before the diffusion process is completed. The temperature for diffusion is kept below 1000° F. to prevent the formation of carbides. The carbon atoms diffuse into a solid solution with the base metal. In this example the article is exposed to the CO gas mixture at a temperature in a range of about 750° F. to 950° F. for up to two weeks. The exact time and temperature parameters will vary depending on the base metal, the amount of diffusion required.

Those skilled in the art will understand that the diffusion time period will determine the depth of the carbon hardened surface because diffusion rate is temperature dependent. Since time also is related to the temperature related formation of carbides, the carburization diffusion process should be controlled to achieve the desired case depth using a time-temperature profile that prevents the formation of carbides for the particular alloy in use. For example, because carbide formation is a function of time and temperature, in cases where a deep case is desired it may be necessary to reduce the temperature during the diffusion process as time goes by to prevent carbide formation.

The lower the temperature of diffusion the longer the diffusion process can last without carbides forming. The drawback is the added time it may take to reach a desired diffusion depth. But in many cases, by keeping the carburization temperature below that temperature at which carbides readily form, for example less than 1000° F. for 316 stainless steel, the article can be case hardened to a sufficient depth without carbides forming.

The drawing illustrates in a representative manner the end result after carburization. After the carbon atoms are diffused into the base metal, a case hardened portion 30 of the article 10 has been formed that is harder than the base metal alloy, in is this example 316 stainless steel, without the formation of carbides. The relative thickness of the hardened portion 30 is exaggerated in the drawing for clarity, and in practice may only be 0.001 to 0.003 inches, for example. This depth dimension is only one example. After the diffusion is completed and the article exposed to air, a chromium oxide layer again forms on the surface of the article.

An alternative process for the activation step is as follows. In this method, a layer of iron is electroplated onto the entire surface of the article. Conventional electroplating techniques can be used. The iron layer need not be thick, for example, about 0.0005 inches or less. The iron layer serves several important functions. First, the plating process automatically activates the article. No separate activation step is required. Second, the iron is transparent to carbon atoms therefore the iron layer can remain on the article during the carburization process. Third, the iron layer allows the article to be exposed to air between the activation and diffusion steps because the iron maintains the article in an activated condition.

After the iron layer is disposed on the article, the diffusion process can be performed. The diffusion process can be the same as described herein before. After the article is carburized, the iron plate is removed by any convenient method such as chemical etching. Once the iron is removed, the case hardened article re-passivates upon exposure to air.

Still further embodiments of the invention will next be described. In one method, the article is placed in a conventional plasma oven. The article is placed on the cathode. Air, and especially nitrogen, is then purged from the furnace. Use of the plasma furnace allows for simultaneous activation and carburization of the article. The plasma furnace is used to establish a glow discharge, for example in the range of about 300 to 500 volts DC in a hydrogen bearing carburizing gas mixture of methane, hydrogen, and argon and an elevated time-temperature history that stays below that temperature that would promote the formation of carbides. In this example the process is carried out at about the range of 700° F. to 950° F. for up to two weeks for example. The hydrogen gas activates the article by carrying away the oxygen from the oxide layer, and the methane provides the carbon atoms for the carburization diffusion. The carburizing gas mixture can be, for example, 1% volume methane or ethane or propane, and 60% volume hydrogen, remainder argon, at 600 Pa pressure.

Another embodiment of the invention involves placing the article in a molten bath of alkali metals (such as, for example, sodium), along with a carbon source such as calcium carbide, within an inert atmosphere of, for example, nitrogen (one atmosphere pressure, for example). The calcium carbide can be, for example, 9–15% weight of the liquid solution. The liquid sodium activates the entire surface area of the article and the carbon can then diffuse into the base metal. Again, in order to prevent the formation of carbides in the article, the process is carried out at a time-temperature profile below that which promotes carbide formation, and for stainless steel alloys for example, below about 1000° F. Again, this diffusion process can take several days or weeks depending on the carburization characteristics required.

In still a further alternative method, in lieu of the liquid sodium bath the article is placed in a molten bath of cyanide salts such as sodium cyanide for example, and metal halide salts such as a potassium chloride and lithium chloride eutectic for example. The molten bath includes a carbon source such as calcium carbide, and the diffusion process is carried out under an inert non-nitrogen atmosphere such as argon and at a time-temperature profile below that temperature which would promote carbide formation (less than 1000° F. for stainless steel alloys for example). In one example, the molten bath includes 3–10% weight sodium cyanide, 45–52% weight potassium chloride, 35–41% weight lithium chloride and 3–10% calcium carbide. The carburization could take place for example over the period of up to two weeks at 750° F., for example. Again, the actual time-temperature profile will depend on the various factors identified herein above including the depth of the diffusion required, the base alloy metal chemistry, the carbon source and so forth.

The various processes described herein involving exposing the article to gas can be accomplished with conventional and commonly available equipment such as a pit furnace, as is well known to those skilled in the art.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A method for case hardening a chromium alloy article, the method comprising:

activating a surface of the article by disposing the article in a molten alkali metal bath; and carburizing the activated surface at a temperature below that temperature which would promote the formation of carbides.

2. The method of claim 1 wherein said carburizing step is performed with the article in said molten alkali bath with said bath including a carbon source.

3. The method of claim 1 wherein said carbon source comprises calcium carbide.

4. A method for case hardening a chromium alloy article, the method comprising:

activating a surface of the article by disposing the article in a molten alkali metal bath or by disposing the article in a molten bath of cyanide salts and metal halide salts; and carburizing the activated surface at a temperature below that temperature which would promote the formation of carbides, carburizing being performed with the article in said molten bath with said bath including a carbon source.

5. A method for case hardening a chromium alloy article, the method comprising:

activating a surface of the article by disposing the article in a molten bath of cyanide salts and metal halide salts; and carburizing the activated surface at a temperature below that temperature which would promote the formation of carbides, carburizing being performed with the article in said molten bath, said bath including a carbon source comprising calcium carbide.

6. A method for case hardening an article made from 316 or 316L stainless steel, the method comprising disposing the article in a molten bath of an alkali metal or a mixture of a cyanide salt and a metal halide salt, the molten bath containing a source of carbon and being maintained at a temperature below that which would promote the formation of carbides.

7. The method of claim 6, wherein the molten bath is maintained below about 1000° F.

8. The method of claim 7, wherein the article is disposed in a molten bath of alkali metal.

9. The method of claim 8, wherein the molten bath contains a carbide.

10. The method of claim 9, wherein the molten bath contains calcium carbide.

11. The method of claim 7, wherein the article is disposed in a molten bath of a cyanide salt and a metal halide salt.

12. The article of claim 11, wherein the molten bath contains a carbide.

13. The method of claim 12, wherein the molten bath contains calcium carbide.

14. The method of claim 6, wherein the article is a ferrule and further wherein the ferrule is maintained in the bath at a temperature below about 1000° F. until the ferrule is case hardened.

15. The method of claim 14, wherein the molten bath contains a carbide.

16. The method of claim 15, wherein the molten bath contains calcium carbide.

17. A method for case hardening an article made from a base metal alloy selected from 316 and 316L stainless steel, the method comprising disposing the article in a molten alkali metal bath maintained at a temperature below that which would promote the formation of carbides, the alkali metal bath containing a source of carbon, maintaining the article in the bath until a case hardened layer harder than the base metal alloy forms on the surfaces of the article, and exposing the article to air to form a chromium oxide layer on these surfaces.

18. The method of claim 17, wherein the temperature of the molten metal bath is maintained below about 1000° F.

19. The method of claim 18, wherein the source of carbon is a carbide.

20. The method of claim 19, wherein the source of carbon is calcium carbide.

21. The method of claim 19, wherein the article is maintained in the bath until a case hardened layer about 0.001 to 0.003 inches thick forms on the surfaces of the article.

22. The method of claim 21, wherein the article is a ferrule.

23. The method of claim 18, wherein the article is maintained in the bath until a case hardened layer about 0.001 to 0.003 inches thick forms on the surfaces of the article.

* * * * *

UNITED STATES PATENT AND TRADEMARK OFFICE

CERTIFICATE OF CORRECTION

PATENT NO. : 6,461,448 B1 
DATED : October 8, 2002
INVENTOR(S) : Peter C. Williams and Steven V. Marx It is certified that error appears in the above-identified patent and that said Letters Patent is hereby corrected as shown below:

Title page,
Item [75], Inventors, after "Peter C. Williams, Cleveland Heights; Steven V. Marx, University Heights, both of OH (US), please add -- Leonard P. Spontelli (deceased). --

Signed and Sealed this

Tenth Day of June, 2003

JAMES E. ROGAN
*Director of the United States Patent and Trademark Office*